US008177871B2

(12) United States Patent
Soma et al.

(10) Patent No.: US 8,177,871 B2
(45) Date of Patent: May 15, 2012

(54) VITRIFIED BONDED GRINDSTONE

(75) Inventors: Shinji Soma, Handa (JP); Hiroshi Morita, Hoi-gun (JP); Tomokazu Yamashita, Nishio (JP)

(73) Assignee: JTEKT Corporation, Osaka-shi (JP)

( * ) Notice: Subject to any disclaimer, the term of this patent is extended or adjusted under 35 U.S.C. 154(b) by 46 days.

(21) Appl. No.: 12/624,710

(22) Filed: Nov. 24, 2009

(65) Prior Publication Data

US 2010/0139173 A1 Jun. 10, 2010

(30) Foreign Application Priority Data

Dec. 4, 2008 (JP) ..... 2008-309374

(51) Int. Cl.
*B24B 1/00* (2006.01)
*B24D 3/00* (2006.01)

(52) U.S. Cl. ..... 51/296; 51/307

(58) Field of Classification Search ..... 51/296, 51/307

See application file for complete search history.

(56) References Cited

U.S. PATENT DOCUMENTS

| | | | | |
|---|---|---|---|---|
| 2,216,728 | A * | 10/1940 | Benner et al. | 51/298 |
| 2,984,555 | A * | 5/1961 | Curtis | 51/309 |
| 4,204,021 | A * | 5/1980 | Becker | 428/325 |
| 5,975,988 | A | 11/1999 | Christianson | |
| 6,500,220 | B1 * | 12/2002 | Krueger et al. | 51/306 |
| 7,297,171 | B2 * | 11/2007 | Rosenflanz | 51/307 |
| 2003/0121212 | A1 * | 7/2003 | Minick et al. | 51/295 |
| 2003/0194954 | A1 * | 10/2003 | Bonner et al. | 451/49 |
| 2004/0088926 | A1 * | 5/2004 | Kinisky et al. | 51/296 |
| 2006/0137256 | A1 * | 6/2006 | Yui et al. | 51/295 |
| 2009/0088056 | A1 | 4/2009 | Takehara et al. | |

FOREIGN PATENT DOCUMENTS

| | | | |
|---|---|---|---|
| DE | 198 05 889 A 1 | | 8/1999 |
| EP | 1 598 147 | A2 | 11/2005 |
| EP | 1 598 147 | A3 | 11/2005 |
| GB | 2 420 786 | A | 6/2006 |
| JP | 07009345 | A * | 1/1995 |
| JP | 07108461 | A * | 4/1995 |
| JP | 08057767 | A * | 3/1996 |
| JP | 2002-224963 | | 8/2002 |
| WO | WO 2008/112914 | A2 | 9/2008 |
| WO | WO 2008/112914 | A3 | 9/2008 |

OTHER PUBLICATIONS http://www.oldham-optical.co.uk/glass.htm, pp. 1-8.*
http://www.engineeringtoolbox.com/linear-expansion-coefficients-d_95.html, pp. 1-12.*
International Search Report issued Aug. 27, 2010 in EP Application No. 09177708.6-2302.

* cited by examiner

*Primary Examiner* — Shuangyi Abu-Ali
*Assistant Examiner* — Ross J Christie
(74) *Attorney, Agent, or Firm* — Oblon, Spivak, McClelland, Maier & Neustadt, L.L.P.

(57) ABSTRACT

In a vitrified bonded grinding wheel that is formed so that superabrasives formed of cubic boron nitride (CBN) grains or diamond grains are bonded and held with a vitrified binder, the vitrified binder is formed of oxide particles and amorphous glass, and the vitrified binder has no open pore that is in fluid communication with outside air.

20 Claims, 2 Drawing Sheets

VITRIFIED BONDED GRINDSTONE

INCORPORATION BY REFERENCE

The disclosure of Japanese Patent Applications No. 2008-309374 filed on Dec. 4, 2008 including the specification, drawings and abstract, is incorporated herein by reference in its entirety.

BACKGROUND OF THE INVENTION

1. Field of the Invention

The invention relates to a vitrified bonded grinding wheel that is formed so that superabrasives, such as cubic boron nitride (CBN) grains or diamond grains, are bonded with an amorphous glass binder.

2. Description of the Related Art

In a prior art, there is a vitrified bonded grinding wheel that is a grinding wheel using vitrified glass as a binder. The vitrified bonded grinding wheel is generally formed so that superabrasives are bonded with an amorphous glass binder in a state called bond bridge. Large open pores that are in fluid communication with outside air are formed between the adjacent bond bridges. Therefore, there is a problem in terms of abrasive grain holding strength, and abrasive grains early drop off, so the conventional vitrified bonded grinding wheel is unsuitable for heavy cutting, or the like. Then, for example, Japanese Patent Application Publication No. 2002-224963 (JP-A-2002-224963) describes a vitrified bonded grinding wheel that eliminates pores from an amorphous glass binder to improve superabrasive holding strength to have the vitrified bonded grinding wheel compatible with heavy cutting.

However, in the vitrified bonded grinding wheel described in JP-A-2002-224963, the amorphous glass binder has no pores, so there is a problem that dressing is difficult and dressing work is time-consuming.

SUMMARY OF THE INVENTION

The invention provides a low-cost and long-life vitrified bonded grinding wheel that has strong abrasive grain holding power and good dressability.

An aspect of the invention relates to a vitrified bonded grinding wheel. The vitrified bonded grinding wheel is formed so that superabrasives formed of cubic boron nitride (CBN) grains or diamond grains are bonded and held with a vitrified binder. The vitrified binder is formed of oxide particles and amorphous glass. The vitrified binder has no open pore that is in fluid communication with outside air.

With the above aspect of the invention, the vitrified binder is formed of the amorphous glass and the oxide particles that are mixed in order to hold the shape during manufacturing of the grinding wheel and improve the strength of the amorphous glass, and the vitrified binder has no open pore that is in fluid communication with outside air. This improves abrasive grain holding power and suppresses abrasion due to drop off of abrasive grains, resulting in the long-life and low-cost vitrified bonded grinding wheel.

In the vitrified bonded grinding wheel according to the above aspect, the vitrified binder may contain fine closed pores that are not in fluid communication with outside air.

With the above aspect of the invention, the vitrified binder contains the fine closed pores that are not in fluid communication with outside air. This may improve dressability of the grinding wheel without decreasing abrasive grain holding power.

In the vitrified bonded grinding wheel according to the above aspect, the ratio A/B of a volume A occupied by the vitrified binder to a volume B occupied by the superabrasives formed of the cubic boron nitride (CBN) grains or the diamond grains in the vitrified bonded grinding wheel may fall within a range of 1 to 6.

With the above aspect of the invention, the ratio A/B of the volume A occupied by the vitrified binder to the volume B occupied by the superabrasives formed of the cubic boron nitride (CBN) grains or the diamond grains in the vitrified bonded grinding wheel falls within a range of 1 to 6. This low concentration of the superabrasives reduces grinding resistance from the beginning of usage to suppress grinding burn. Hence, the quality of the vitrified bonded grinding wheel improves, and the long service life of the vitrified bonded grinding wheel is attained.

In the vitrified bonded grinding wheel according to the above aspect, the volume ratio of the oxide particles and the amorphous glass that constitute the vitrified binder may fall within a range of 3:7 to 4:6.

With the above aspect of the invention, the volume ratio of the oxide particles and the amorphous glass that constitute the vitrified binder falls within a range of 3:7 to 4:6. This suppresses flow of the amorphous glass, and makes it possible to mold the shape of the vitrified bonded grinding wheel into a desired shape.

In the vitrified bonded grinding wheel according to the above aspect, the oxide particles and the amorphous glass each may have a coefficient of linear thermal expansion of $(3.5\pm2)\times10^{-6}$(1/° C.).

With the above aspect of the invention, the oxide particles and the amorphous glass each have a coefficient of linear thermal expansion of $(3.5\pm2)\times10^{-6}$(1/° C.). The coefficient of linear thermal expansion of each of the oxide particles and the amorphous glass is substantially equal to the coefficient of linear thermal expansion of the abrasive grains. Thus, there is no possibility that a change in temperature causes the abrasive grains to be removed from the oxide particles and the amorphous glass. Hence, the quality of the grinding wheel is maintained.

In the vitrified bonded grinding wheel according to the above aspect, the diameters of the fine closed pores may be 1 percent to between 10 and 20 percent of the grain diameters of the superabrasives.

With the above aspect of the invention, the diameters of the fine closed pores are 1 percent to between ten and twenty percent of the grain diameters of the superabrasives. This stably maintains abrasive grain holding power while making it possible to further improve dressability of the grinding wheel.

In the vitrified bonded grinding wheel according to the above aspect, the fine closed pores may be closed in the vitrified binder at a volume fraction of 8 percent±4 percent.

With the above aspect of the invention, the fine closed pores are mixed in the vitrified binder at a volume fraction of 8 percent±4 percent. By so doing, the vitrified bonded grinding wheel stably and firmly holds the superabrasives formed of the cubic boron nitride (CBN) grains or the diamond grains, and has good dressability that allows dressing work in a short period of time.

In the vitrified bonded grinding wheel according to the above aspect, the fine closed pores may be formed in the vitrified bonded grinding wheel so that a predetermined amount of powdery foaming agent is mixed into the vitrified binder before firing and then the foaming agent reacts with the amorphous glass during firing to be foamed.

With the above aspect of the invention, the fine closed pores are formed in the vitrified bonded grinding wheel so that the powdery foaming agent is mixed into the glass agent before firing and then the foaming agent reacts with the glass agent during firing to be foamed. By so doing, a predetermined amount of fine closed pores may be easily obtained in the vitrified bonded grinding wheel, and it is possible to obtain performance that the superabrasives are firmly held and dressing work is allowed in a short period of time at low cost.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
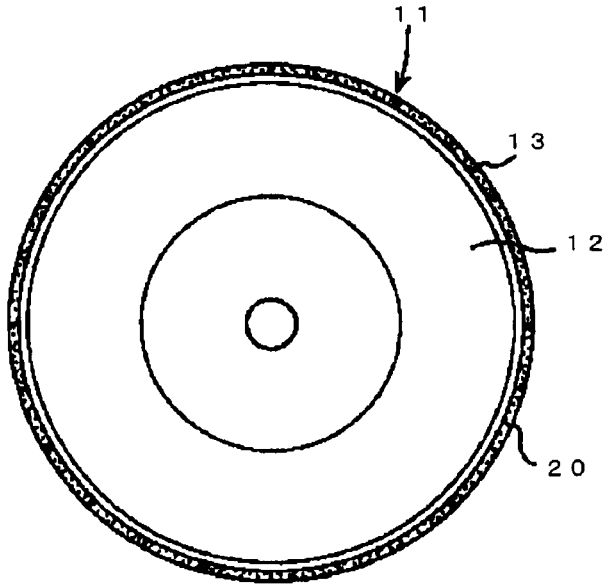
FIG. 1 is a view that shows a grinding wheel in which vitrified bonded superabrasive grinding wheels are bonded on an outer periphery of a base.

Hereinafter, an embodiment of the invention will be described with reference to the accompanying drawings. As shown in FIG. 1, a grinding wheel 11 is formed so that a plurality of 5 to 10-mm thick arcuate vitrified bonded grinding wheels 13 are bonded on an outer peripheral surface of a disk-shaped base 12 formed of a metal, such as iron and aluminum.

Figure 2:
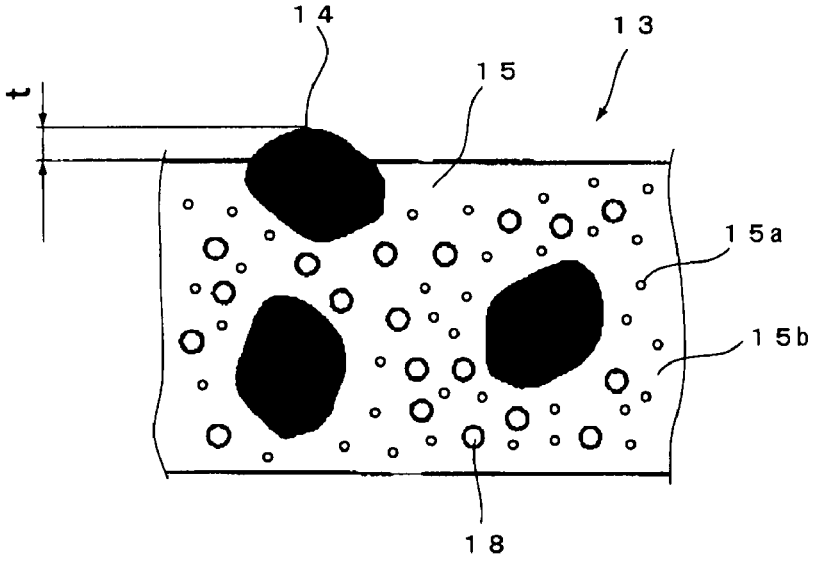
FIG. 2 is a schematic view that shows the composition of a vitrified bonded grinding wheel according to an embodiment of the invention.

As shown in the schematic view of FIG. 2, each vitrified bonded grinding wheel 13 is composed of superabrasives 14 and a vitrified binder 15. The superabrasives 14 are, for example, cubic boron nitride (CBN) grains or diamond grains. The vitrified binder 15 is formed of oxide particles 15*a* and amorphous glass 15*b* that serves as a binder. The superabrasives 14 are mostly covered with the vitrified binder 15. The vitrified binder 15 contains a predetermined amount of fine closed pores 18. However, no open pores that are in fluid communication with outside air are formed.

The oxide particles 15*a* are additives for improving the strength of the amorphous glass 15*b*. The oxide particles 15*a* are, for example, $ZrSiO_4$ (zircon), which is a silicate mineral, $TiO_2$ (titania), $ZrO_2$ (zirconia), $Cr_2O_3$ (chromia), or the like. The amorphous glass 15*b* is, for example, borosilicate glass, or the like. The oxide particles 15*a* and the amorphous glass 15*b* each desirably have a coefficient of linear thermal expansion that falls within a range of $(3.5\pm2)\times10^{-6}$(1/° C.) that is substantially equal to the coefficient of linear thermal expansion of the superabrasives 14 to be bonded. The coefficient of linear thermal expansion of each of the oxide particles 15*a* and the amorphous glass 15*b* is substantially equal to the coefficient of linear thermal expansion of the superabrasives 14. Thus, there is no possibility that a change in temperature causes the superabrasives 14 to be removed from the oxide particles 15*a* and the amorphous glass 15*b*. Hence, the quality of the vitrified bonded grinding wheels 13 is maintained. Note that the oxide particles 15*a* may be, for example, aluminum oxide ($Al_2O_3$), or the like. The amorphous glass 15*b* may be, for example, phosphate glass, borate glass, or the like.

The oxide particles 15*a* and the amorphous glass 15*b* are mixed at a volume ratio of 3:7 to 4:6 to form the vitrified binder 15. This is because, when the mixture fraction of the oxide particles 15*a* is lower than or equal to 30 percent, it is difficult to suppress flow of the amorphous glass 15*b* and, therefore, the shape of each vitrified bonded grinding wheel 13 cannot be maintained before firing or during firing, so the edges are deformed. On the other hand, when the mixture fraction is higher than or equal to 40 percent, the amorphous glass 15*b* containing the oxide particles 15*a* becomes excessively strong and hard, therefore, dressability becomes poor and a large amount of heat is generated during grinding. This may cause grinding burn. In each vitrified bonded grinding wheel 13 according to the embodiment of the invention, the mixture fraction of the oxide particles 15*a* is set so as to fall within a range of 30 to 40 percent by volume to thereby fire the grinding wheel 13 having an appropriate hardness into a desired shape.

In addition, the ratio A/B of a volume A occupied by the vitrified binder 15 to a volume B occupied by the superabrasives 14 in each vitrified bonded grinding wheel 13 desirably falls within a range of 1 to 6. The volume ratio within a range of 1 to 6 corresponds to 50 to 200 when converted into the concentration of the superabrasives 14. Because of the low concentration, the vitrified bonded grinding wheels 13 do not receive large grinding resistance from the beginning, so grinding burn hardly occurs.

When the vitrified binder 15 is mixed with, for example, $ZrSiO_4$ (zircon) particles, which correspond to the oxide particles 15*a*, and then fired, the vitrified binder 15 mostly covers the outer periphery of the superabrasives 14 to fill any gaps between the adjacent superabrasives 14 and is bonded with the superabrasives 14. The vitrified binder 15 filling the gaps contains the fine closed pores 18 having a predetermined volume ratio. The fine closed pores 18 are fine closed cells that are not in fluid communication with outside air. The predetermined volume ratio is a volume ratio suitable for maintaining the holding power of the vitrified binder 15 to the superabrasives 14 and maintaining good dressability for the vitrified binder 15. The volume ratio should be set at 8 percent±4 percent with respect to the volume of the amorphous glass 15*b* that constitutes the vitrified binder 15. The volume of the fine closed pores 18 is controlled by regulating the amount of foaming agent mixed during a manufacturing process, which will be described later. In addition, the average diameter of the fine closed pores 18 is desirably formed to have 1 to between 10 and 20 percent of the average diameter of the superabrasives 14 in order to maintain the holding power of the vitrified binder 15 to the superabrasives 14 and maintain good dressability for the vitrified binder 15.

Next, a method of manufacturing the vitrified bonded grinding wheel 13 will be described. First, the powder of the oxide particles 15*a*, which is the raw material of the vitrified binder 15, is uniformly mixed with the powder of the amorphous glass 15*b* so that the volume ratio falls within a range of 3:7 to 4:6.

Subsequently, the superabrasives 14, such as cubic boron nitride (CBN) grains or diamond grains, are mixed into the vitrified binder 15 and uniformly dispersed. The mixture ratio is set so that a volume ratio A/B of the volume A of the vitrified binder 15 to the volume B of the superabrasives 14 falls within a range of 1 to 6.

In addition, in order to form the fine closed pores 18 in the vitrified binder 15, the above described foaming agent, such as hexagonal boron nitride (HBN), is uniformly mixed in a powdery state. At this time, the input of the foaming agent is desirably 0.5 percent to 2 percent with respect to the volume of the amorphous glass 15*b*. Note that the foaming agent may be fluorite ($CaF_2$), calcium carbonate ($CaCO_3$), or the like.

After that, the vitrified binder 15 is pressed at a predetermined pressure in a die for molding, and is then fired. Note that by regulating the pressing pressure, it is possible to slightly regulate the strength of the vitrified binder. Then, at the stage of firing, the foaming agent, such as hexagonal boron nitride (HBN), reacts with the amorphous glass 15*b* to generate gas. A predetermined amount of the generated gas is formed in the vitrified binder 15 as the fine closed pores 18 to obtain the vitrified bonded grinding wheel 13.

At this time, the average diameter of the fine closed pores 18 is desirably formed to have 1 to between 10 and 20 percent of the average diameter of the superabrasives 14 as described above. Specifically, for example, if the average diameter of the superabrasives 14 is 100 micrometers, the average diameter of the fine closed pores 18 should be several micrometers or between 10 and 20 micrometers. This configuration is attained by regulating the input of the foaming agent. Then, as shown in FIG. 1, the vitrified bonded grinding wheels 13 are bonded onto the outer peripheral surface of the base 12 by a bonding agent to obtain the grinding wheel 11.

Next, the operation of the vitrified bonded grinding wheels 13 according to the embodiment of the invention during grinding will be described. The grinding wheel 11 is fixed to a rotatably supported grinding wheel spindle of a grinding machine and is driven for rotation. A workpiece is held between a headstock and a tailstock and is driven for rotation. Then, a wheelhead is fed for grinding toward the workpiece while supplying coolant between the grinding wheel 11 and the workpiece to thereby grind the workpiece with the vitrified bonded grinding wheels 13, bonded on the outer peripheral surface of the grinding wheel 11, according to the embodiment of the invention. Note that, at this time, the superabrasives 14 of the vitrified bonded grinding wheels 13 are protruded on a grinding surface 20 by truing and dressing work, and a chip pocket is formed between the adjacent protruded superabrasives 14.

The surface of the workpiece is ground and removed by the superabrasives 14 protruded on the grinding surface 20 of the vitrified bonded grinding wheel 13, and cutting chips are produced. The produced cutting chips are ejected into chip pockets formed between the superabrasives 14 protruded on the grinding surface 20. Cutting chips ejected into the chip pockets do not contact the workpiece, so there is no concern about a damage to the surface of the workpiece. In addition, the superabrasives 14 of the vitrified bonded grinding wheels 13 are molded at a low concentration. This suppresses heating by the contact with the workpiece and prevents grinding burn. After that, with the progress of grinding, finally, the superabrasives 14 are worn, and the protrusion t (see FIG. 2) of each superabrasive 14 from the grinding surface 20 is reduced. Then, dressing is carried out to cause the grinding surface 20 to recede. At this time, the vitrified binder 15 has a predetermined amount of the fine closed pores 18, and the fine closed pores 18 are formed so as to have no open pores that are in fluid communication with outside air. Thus, the vitrified bonded grinding wheel has good dressability and allows dressing work in a short period of time, and, in addition, has sufficient holding power to the superabrasives 14, so there is no concern about abrasion due to early drop off of abrasive grains.

Figure 3:
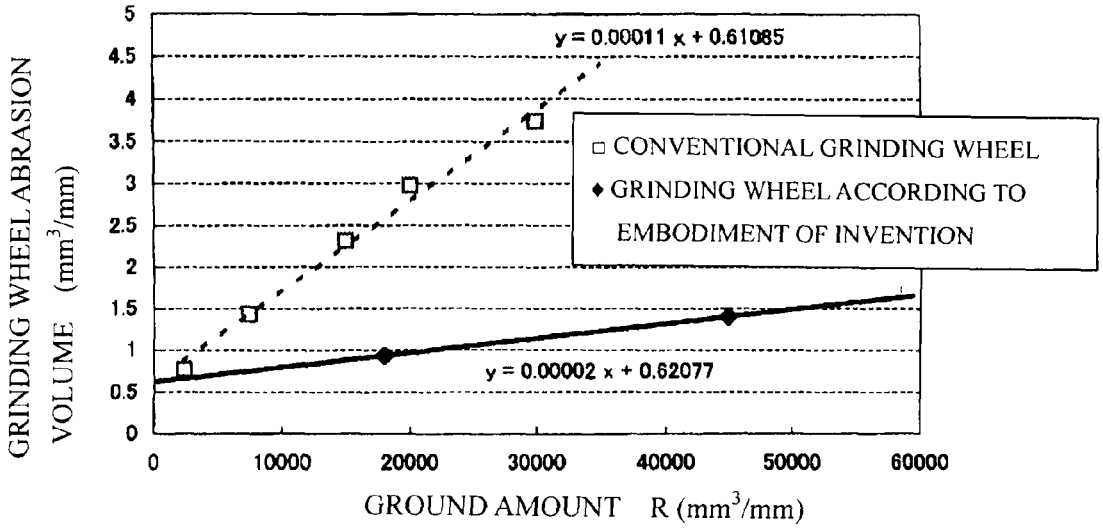
FIG. 3 is a graph that shows the relationship between an abrasion volume of the grinding wheel and a ground volume of a workpiece through grinding.

Here, the experimental results of measured grinding ratios in order to determine the holding power of the vitrified bonded grinding wheels 13 according to the embodiment of the invention to the superabrasives 14 are shown in FIG. 3. FIG. 3 is a graph that has an ordinate axis of an abrasion volume per unit length ($mm^3$/mm) of the grinding wheel and an abscissa axis of a ground amount R per unit length ($mm^3$/mm) of the workpiece. FIG. 3 shows both the results of the conventional vitrified bonded grinding wheel (broken line) and the results of the vitrified bonded grinding wheel 13 (solid line) according to the embodiment of the invention. As is apparent from the graph, it can be recognized that the values of the abrasion volume of the grinding wheel to the amount R of the workpiece ground by the vitrified bonded grinding wheel 13 according to the embodiment of the invention is by far smaller than the values of the abrasion volume of the conventional vitrified bonded grinding wheel. That is, the strength of the vitrified binder 15 according to the embodiment of the invention is improved. Therefore, it is found that, although the same grinding work as that in the prior art is carried out, abrasion of the vitrified bonded grinding wheel 13, that is, abrasion attended with drop off of the superabrasives 14, is reduced, and the holding power of the vitrified binder 15 to the superabrasives is improved. The results show that the holding power is improved by five times or more of the holding power of the prior art. It is found that, while maintaining good dressability, the holding power to the superabrasives 14 is sufficiently ensured, and the long-life vitrified bonded grinding wheel 13 is obtained.

Furthermore, other than the experiment shown in FIG. 3, on the assumption that the superabrasive holding strength is directly proportional to the bending strength, a bending strength test described in JISG0202 was conducted on the vitrified bonded grinding wheel. The results showed that the vitrified bonded grinding wheel 13 according to the embodiment of the invention exhibited about 60 percent of improvement in bending strength with respect to the conventional vitrified bonded grinding wheel. According to the above results as well, it has proven that the holding strength of the vitrified bonded grinding wheel 13 according to the embodiment of the invention to the superabrasives 14 is improved.

The invention claimed is:

1. A vitrified bonded grinding wheel that is formed so that superabrasives formed of cubic boron nitride (CBN) grains or diamond grains are bonded and held with a vitrified binder, wherein:

the vitrified binder is formed of oxide particles and amorphous glass, the vitrified binder contains closed pores that are not in fluid communication with outside air, the diameters of the closed pores are 1 to 20 percent of the grain diameters of the superabrasives, and the closed pores are formed so that the vitrified binder has no open pore that is in fluid communication with outside air.

2. The vitrified bonded grinding wheel according to claim 1, wherein the ratio A/B of a volume A occupied by the vitrified binder to a volume B occupied by the superabrasives formed of the cubic boron nitride (CBN) grains or the diamond grains in the vitrified bonded grinding wheel falls within a range of 1 to 6.

3. The vitrified bonded grinding wheel according to claim 1, wherein the volume ratio of the oxide particles and the amorphous glass that constitute the vitrified binder falls within a range of 3:7 to 4:6.

4. The vitrified bonded grinding wheel according to claim 1, wherein the oxide particles and the amorphous glass each has a coefficient of linear thermal expansion of $(3.5\pm2)\times10^{-6}$(1/° C.).

5. The vitrified bonded grinding wheel according to claim 1, wherein the diameters of the closed pores are 1 to 10 percent of the grain diameters of the superabrasives.

6. The vitrified bonded grinding wheel according to claim 1, wherein the closed pores are closed in the vitrified binder at a volume fraction of 8percent ±4 percent.

7. The vitrified bonded grinding wheel according to claim 1, wherein the closed pores are formed in the vitrified bonded grinding wheel so that a predetermined amount of powdery foaming agent is mixed into the vitrified binder before firing and then the foaming agent reacts with the amorphous glass during firing to be foamed.

8. The vitrified bonded grinding wheel according to claim 1, wherein the diameters of the closed pores are 10 to 20 percent of the grain diameters of the superabrasives.

9. The vitrified bonded grinding wheel according to claim 2, wherein the volume ratio of the oxide particles and the amorphous glass that constitute the vitrified binder falls within a range of 3:7 to 4:6.

10. The vitrified bonded grinding wheel according to claim 2, wherein the oxide particles and the amorphous glass each has a coefficient of linear thermal expansion of $(3.5\pm2)\times10^{-6}$(1/° C.).

11. The vitrified bonded grinding wheel according to claim 2, wherein the diameters of the closed pores are 1 to 10 percent of the grain diameters of the superabrasives.

12. The vitrified bonded grinding wheel according to claim 2, wherein the closed pores are closed in the vitrified binder at a volume fraction of 8percent ±4 percent.

13. The vitrified bonded grinding wheel according to claim 2, wherein the closed pores are formed in the vitrified bonded grinding wheel so that a predetermined amount of powdery foaming agent is mixed into the vitrified binder before firing and then the foaming agent reacts with the amorphous glass during firing to be foamed.

14. The vitrified bonded grinding wheel according to claim 3, wherein the oxide particles and the amorphous glass each has a coefficient of linear thermal expansion of $(3.5\pm2)\times10^{-6}$(1/° C.).

15. The vitrified bonded grinding wheel according to claim 3, wherein the diameters of the closed pores are 1 to 10 percent of the grain diameters of the superabrasives.

16. The vitrified bonded grinding wheel according to claim 3, wherein the closed pores are closed in the vitrified binder at a volume fraction of 8percent ±4 percent.

17. The vitrified bonded grinding wheel according to claim 3, wherein the closed pores are formed in the vitrified bonded grinding wheel so that a predetermined amount of powdery foaming agent is mixed into the vitrified binder before firing and then the foaming agent reacts with the amorphous glass during firing to be foamed.

18. The vitrified bonded grinding wheel according to claim 4, wherein the closed pores are closed in the vitrified binder at a volume fraction of 8percent ±4 percent.

19. The vitrified bonded grinding wheel according to claim 4, wherein the closed pores are formed in the vitrified bonded grinding wheel so that a predetermined amount of powdery foaming agent is mixed into the vitrified binder before firing and then the foaming agent reacts with the amorphous glass during firing to be foamed.

20. The vitrified bonded grinding wheel according to claim 6, wherein the closed pores are formed in the vitrified bonded grinding wheel so that a predetermined amount of powdery foaming agent is mixed into the vitrified binder before firing and then the foaming agent reacts with the amorphous glass during firing to be foamed.

* * * * *